US006786014B2

(12) United States Patent
Kishimoto et al.

(10) Patent No.: US 6,786,014 B2
(45) Date of Patent: Sep. 7, 2004

(54) OFFICE FORMING EQUIPMENT

(75) Inventors: Akihiro Kishimoto, Osaka (JP); Fumihiko Nomura, Osaka (JP)

(73) Assignee: Kokuyo Co., Ltd. (JP)

( * ) Notice: Subject to any disclaimer, the term of this patent is extended or adjusted under 35 U.S.C. 154(b) by 0 days.

(21) Appl. No.: 10/276,864

(22) PCT Filed: Mar. 29, 2002

(86) PCT No.: PCT/JP02/03234

§ 371 (c)(1),
(2), (4) Date: Nov. 20, 2002

(87) PCT Pub. No.: WO02/079587

PCT Pub. Date: Oct. 10, 2002

(65) Prior Publication Data

US 2003/0136066 A1 Jul. 24, 2003

(30) Foreign Application Priority Data

Mar. 30, 2001 (JP) ..... 2001-102658

(51) Int. Cl.[7] ..... E02D 1/00

(52) U.S. Cl. ..... 52/220.7; 52/239; 52/220.8

(58) Field of Search ..... 52/479, 475.1, 52/36.1, 220.7, 220.8, 221.1, 239, 481.2, 660, 664, 666; 160/135, 351; 256/19, 24, 73

(56) References Cited

U.S. PATENT DOCUMENTS

| | | | | | |
|---|---|---|---|---|---|
| 1,176,692 | A | * | 3/1916 | Smith | 52/241 |
| 1,180,431 | A | * | 4/1916 | Ritter | 52/473 |
| 1,238,646 | A | * | 8/1917 | Dennis | 160/230 |
| 1,457,909 | A | * | 6/1923 | Lloyd | 52/506.05 |
| 1,661,003 | A | * | 2/1928 | Miller | 160/229.1 |
| 3,570,683 | A | * | 3/1971 | Dickgiesser et al. | 211/162 |
| 3,651,851 | A | * | 3/1972 | Curtis | 160/135 |
| 3,844,231 | A | * | 10/1974 | Peacock | 108/107 |
| 4,127,196 | A | * | 11/1978 | Boucher | 211/207 |
| 4,573,513 | A | * | 3/1986 | Small et al. | 160/135 |
| 4,794,744 | A | * | 1/1989 | Young et al. | 256/24 |
| 5,078,367 | A | * | 1/1992 | Simpson et al. | 256/24 |
| 5,100,108 | A | * | 3/1992 | Schultz | 256/24 |
| 5,155,955 | A | * | 10/1992 | Ball et al. | 52/126.4 |
| 5,265,739 | A | * | 11/1993 | Price et al. | 211/162 |
| 5,528,876 | A | * | 6/1996 | Lu | 52/654.1 |
| 5,529,192 | A | * | 6/1996 | Conen et al. | 211/189 |
| 5,617,700 | A | * | 4/1997 | Wright et al. | 52/793.1 |
| 5,671,913 | A | * | 9/1997 | Vesper | 256/31 |
| 5,813,177 | A | * | 9/1998 | Wu | 52/238.1 |
| 5,918,750 | A | * | 7/1999 | Jackson | 211/189 |
| 5,967,214 | A | * | 10/1999 | Beretta | 160/135 |
| 6,189,270 | B1 | * | 2/2001 | Jeffers et al. | 52/220.7 |
| 6,345,478 | B1 | * | 2/2002 | Pang | 52/239 |

FOREIGN PATENT DOCUMENTS

| | | | | |
|---|---|---|---|---|
| JP | 52-117812 | | 9/1977 | |
| JP | 63-116614 | | 7/1988 | |
| JP | 04108940 | A * | 4/1992 | E04B/2/74 |
| JP | 2920348 | B2 | 7/1999 | |
| JP | 2000-144982 | A | 5/2000 | |
| WO | WO 8801667 | A1 * | 3/1988 | E04C/2/38 |

* cited by examiner

*Primary Examiner*—Peter M. Cuomo
*Assistant Examiner*—Stephen D'Adamo
(74) *Attorney, Agent, or Firm*—Banner & Witcoff Ltd.

(57) ABSTRACT

Office forming equipment includes a partition panel partitioning a residence space of an office and is constructed such that a pair of spaces separated from each other with the partition panel have such a mutual relation that the visibility of one of the spaces from the other through the erected planar member varies with varying view angle with respect to an erected surface of the erected planar member. This construction makes it possible to enhance the efficiency of an organization of a knowledge-intensive type markedly.

7 Claims, 9 Drawing Sheets

PRIOR ART

OFFICE FORMING EQUIPMENT

TECHNICAL FIELD

The present invention relates to office forming equipment which is applicable to knowledge-intensive organizations and the like particularly advantageously.

BACKGROUND ART

Recently, there has been made a proposal of a system capable of converting the use of a workspace of an office into a different use and customizing such a workspace to meet the need.

Such an office system has been proposed as a system capable of constructing a totalized workspace based on "unification of modules" and "optionality" as mainstays with respect mainly to furniture so that functions of the workspace can be selected freely and that conversion of use of the workspace can be made as desired, on the assumption that there are diversified working styles in a center office.

That is, the office system is constructed aiming principally at such functionality as to form an independent group work dedicated space, a personal work dedicated space or the like appropriately through the changing of the arrangement of furniture and the attaching or detaching of optional members with changing work style.

From now on, however, it seems that: work styles will change with increasing amounts of non-routine works for individuals or groups; workplaces will change from center offices into flexible and diversified office forms such as remote offices, mobile offices and home offices; and center offices will have an increased number of communication areas and service areas. With respect to specialist teams or knowledge work teams, the form of a team will continuously change with progress of a work in the procedure of one development through, for example, repetitive and frequent meeting and parting of staff members about group works and changes in the number and actions of such members.

It is indispensable for a working environment suited for such a work style to be capable of not only easy conversion of use of a workspace and easy customization of such a workspace but also appropriate selection of spaces suitable for diversified works of individuals or groups and for the number of working people as well as to ensure a chain of actions and continuity of moves as selection of such works and places changes. To this end, it is desirable to create an environment wherein: areas of different uses or different functions be loosely connected to each other; and each member of a team somehow grasp the flow of the task of the whole team and the locations of other members and documents.

DISCLOSURE OF INVENTION

The present invention has been made in view of the foregoing problem. One object of the present invention is to raise the efficiency of a knowledge-intensive organization markedly through a system configuration that realizes the provisions of diversified space functions on a use-by-use basis, semi-transparently screened spaces and seamless space layout, which serve as the mainstays in constructing an office system.

Another object of the present invention is to provide office forming equipment useful in attaining the above-described object.

That is, the present invention provides office forming equipment comprising an erected planar member partitioning a residence space of an office, characterized in that the erected planar member is configured such that the visibility of one of a pair of spaces separated with the erected planar member from the other through the erected planar member varies with varying view angle with respect to an erected surface of the erected planar member.

Such a construction allows a person in one of the spaces to grasp the condition of the other space while, at the same time, providing a support in protecting the privacy of an individual or a group in the office. Accordingly, this construction creates a semi-transparently screened environment, which allows the context (information required in grasping the relation between before and after such as the flow of operations or documents) related to actions, operations and documents in the peripheral visual field to be shared and accumulated.

The following are preferred embodiments:

An embodiment wherein the erected planar member is provided with an adjustment function for making the visibility therethrough variable.

An embodiment wherein the visibility through the erected planar member assumes a maximum when the erected planar member is viewed in a direction normal to the erected surface of the erected planar member, while when the erected planar member is viewed in a direction in the plane of the erected surface, the visibility assumes a minimum.

An embodiment wherein the pair of residence spaces separated from each other with the erected planar member are continuous with each other through a space connecting portion of the erected planar member, the space connecting portion permitting sound and air to pass therethrough.

An embodiment wherein the erected planar member comprises a latticework structure. Particularly, an embodiment wherein the erected planar member comprises a pair of latticework structures arranged to face each other with a predetermined spacing therebetween.

Since the present invention is thus constructed, the office forming equipment is effective particularly where the inside of a residence space enclosed with erected planar members is visible from four sides.

As described above, the office forming equipment according to the present invention comprises an erected planar member partitioning a residence space of an office and is constructed such that a pair of spaces separated from each other with the erected planar member have such a mutual relation that the visibility of one of the spaces from the other through the erected planar member varies with varying view angle with respect to an erected surface of the erected planar member.

Such a construction allows a person in one of the spaces to grasp the condition of the other space while, at the same time, providing a support in protecting the privacy of an individual or a group in the office. Accordingly, this construction creates a semi-transparently screened environment, which allows the context (information required in grasping the relation between before and after such as the flow of operations or documents) related to actions, operations and documents in the peripheral visual field to be shared and accumulated.

With the erected planar member provided with an adjustment function for making the visibility therethrough variable, it is possible to adjust the degree of isolation to meet the purpose and use as desired.

With the arrangement wherein the visibility through the erected planar member assumes a maximum when the erected planar member is viewed in a direction normal to the erected surface of the erected planar member, while when the erected planar member is viewed in a direction in the plane of the erected surface, the visibility assumes a minimum, a person walking along the erected planar member can see the inside of a residence space in a silhouetted fashion through the erected planar member gradually from a place before reaching the residence space, with the visibility assuming the maximum when the person passes the front face of the residence space. For this reason, the context can be shared and accumulated without much impediment to a resident in the residence space.

With the arrangement wherein the pair of residence spaces separated from each other with the erected planar member are continuous with each other through a space connecting portion of the erected planar member, the space connecting portion permitting sound and air to pass therethrough, a person outside a residence space of interest can hear talking voices in the residence space partially, so that the sharing and accumulation of the context is facilitated effectively.

With the erected planar member comprising a latticework structure, the aforementioned arrangements can be realized simply and accurately. Particularly effective is the arrangement wherein the erected planar member comprises a pair of latticework structures arranged to face each other with a predetermined spacing therebetween.

Since the present invention is thus constructed, the office forming equipment of the arrangement wherein the inside of a residence space enclosed with erected planar members is visible from four sides, is most effective.

BEST MODE FOR CARRYING OUT THE INVENTION

Hereinafter, one embodiment of the present invention will be described with reference to the drawings.

Residence space forming equipment according to this embodiment is constructed to support a specialist team or knowledge work team, for example, a research and development team of a suggestion type, a designing team or the like.

To improve the team performance of such a knowledge work team, a personal creative process support is needed for autonomous knowledge workers, while on the other hand a group creative process support needed for non-routine and communication processes.

Taking into consideration the points: a work style of this type is for a flexible knowledge-intensive organization; and importance should be attached to team performance, and like points, and in view of the influence brought by the combination of a personal space and a shared space, the residence space is formed as follows.

First, work areas and shared areas are considered as areas to be formed. Then, as shown in the conceptual illustration at FIG. 1, work areas a1 to a6 are divided into two groups, which in turn are arranged adjacent to shared areas b1 to b3, whereby the shared areas b1 to b3 can be utilized as a passageway for traffic between work areas a1 to a3 and work areas a4 to a6. For example, areas a2 and a5 are provided as group work areas GW for working on a group basis, while areas a1, a3, a4 and a6 provided as personal work areas PW for working on an individual basis. Shared areas b1 and b3 are interaction areas INT and shared area b2 is a service area SV. These areas a1 to a6 and b1 to b3 allow direct traffic between adjacent shared areas, between adjacent work areas and between a shared area and a work area, which are situated adjacent to each other.

Figure 1:
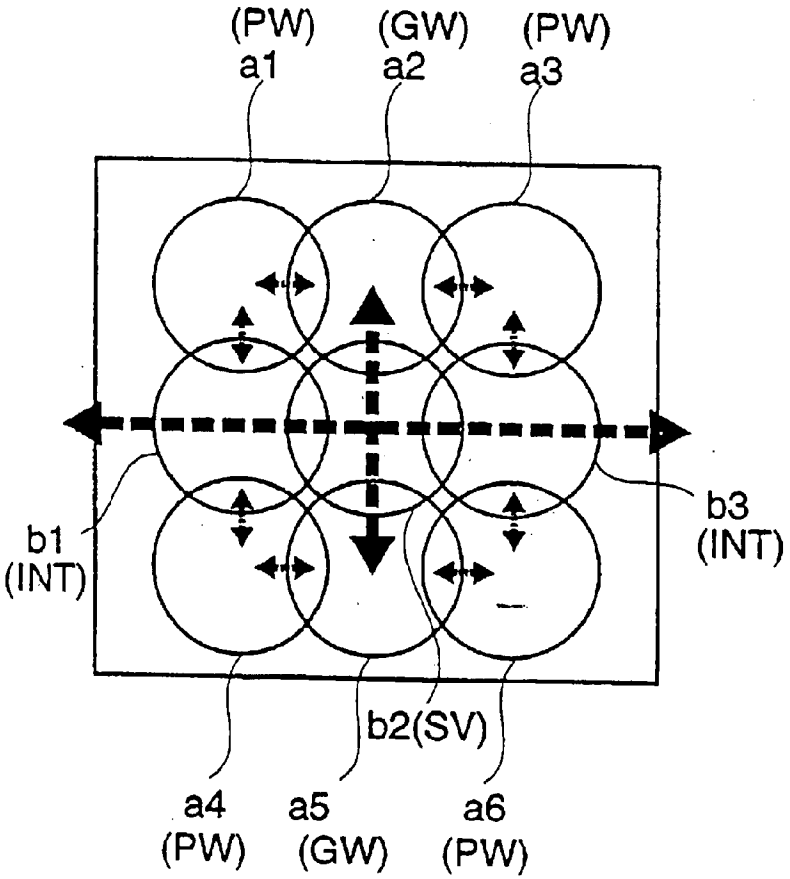
FIG. 1 is a conceptual illustration showing a concept based on which one embodiment of the present invention is to be constructed.
Figure 2:
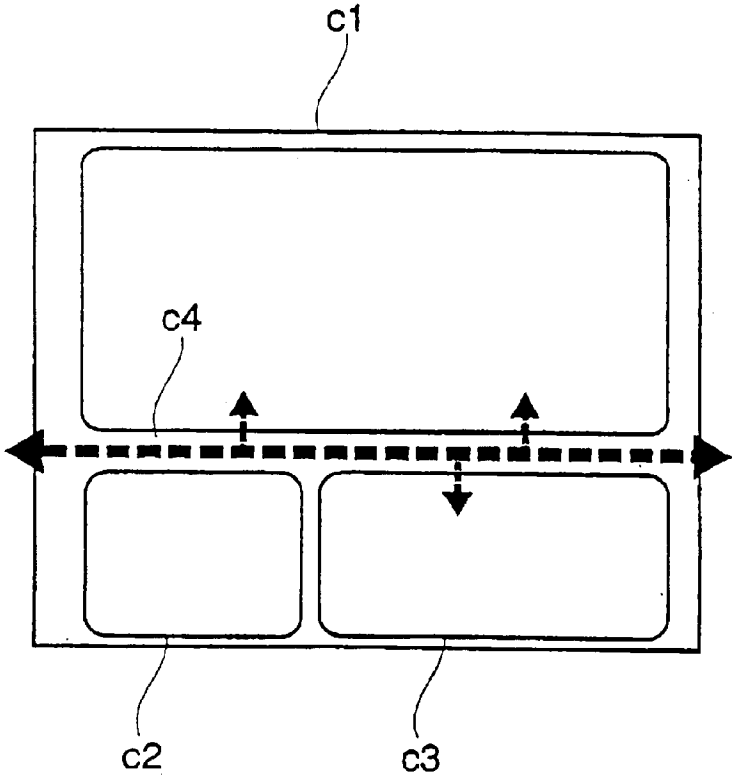
FIG. 2 is an illustration showing a conventional construction corresponding to FIG. 1.

FIG. 2 shows a conventional system for comparison with the system shown in FIG. 1, wherein there is a dedicated passageway c4 between work area cl and shared areas c2 and c3 (i.e., service area c2 and communication area c3).

Figure 3:
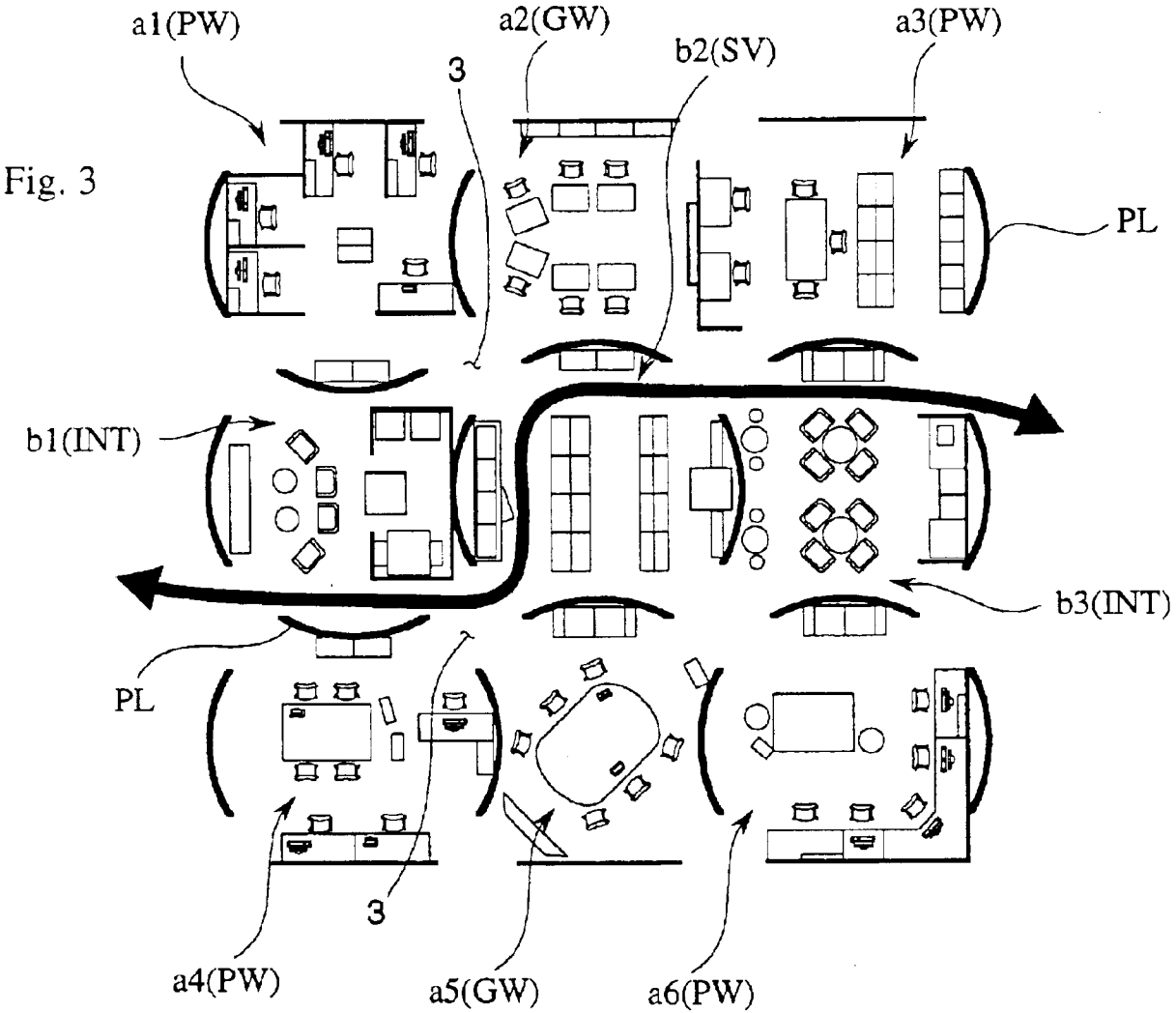
FIG. 3 is a plan view of a construction embodying the concept shown in FIG. 1.

While FIG. 1 is a conceptual illustration in which circles are shown as overlapping each other to mean that areas are vaguely continuous with each other, FIG. 3 is an illustration in which parting lines PL between areas are clearly shown to embody the concept of FIG. 1 to some extent. In FIG. 3 corresponding to FIG. 1, shared areas b1 and b3 are interaction areas INT and shared area b2 is a service area SV. Work areas a2 and a5 are group work areas GW, while work areas a1, a3, a4 and a6 are personal work areas PW. That is, this design includes six work areas a1 to a6 and three shared areas b1 to b3, the shared areas b1 to b3 being arranged serially, the work areas a1 to a3 and the work areas a4 to a6 being arranged serially on opposite sides of the shared areas b1 to b3. FIG. 3 clearly shows a conception of opening a parting line PL at a location where areas meet together and providing a gateway 3 at that location in order to allow traffic between adjacent shared areas, between adjacent work areas and between a shared area and a work area adjacent thereto as well as to realize an embodiment having areas vaguely continuous with each other.

Figure 4:
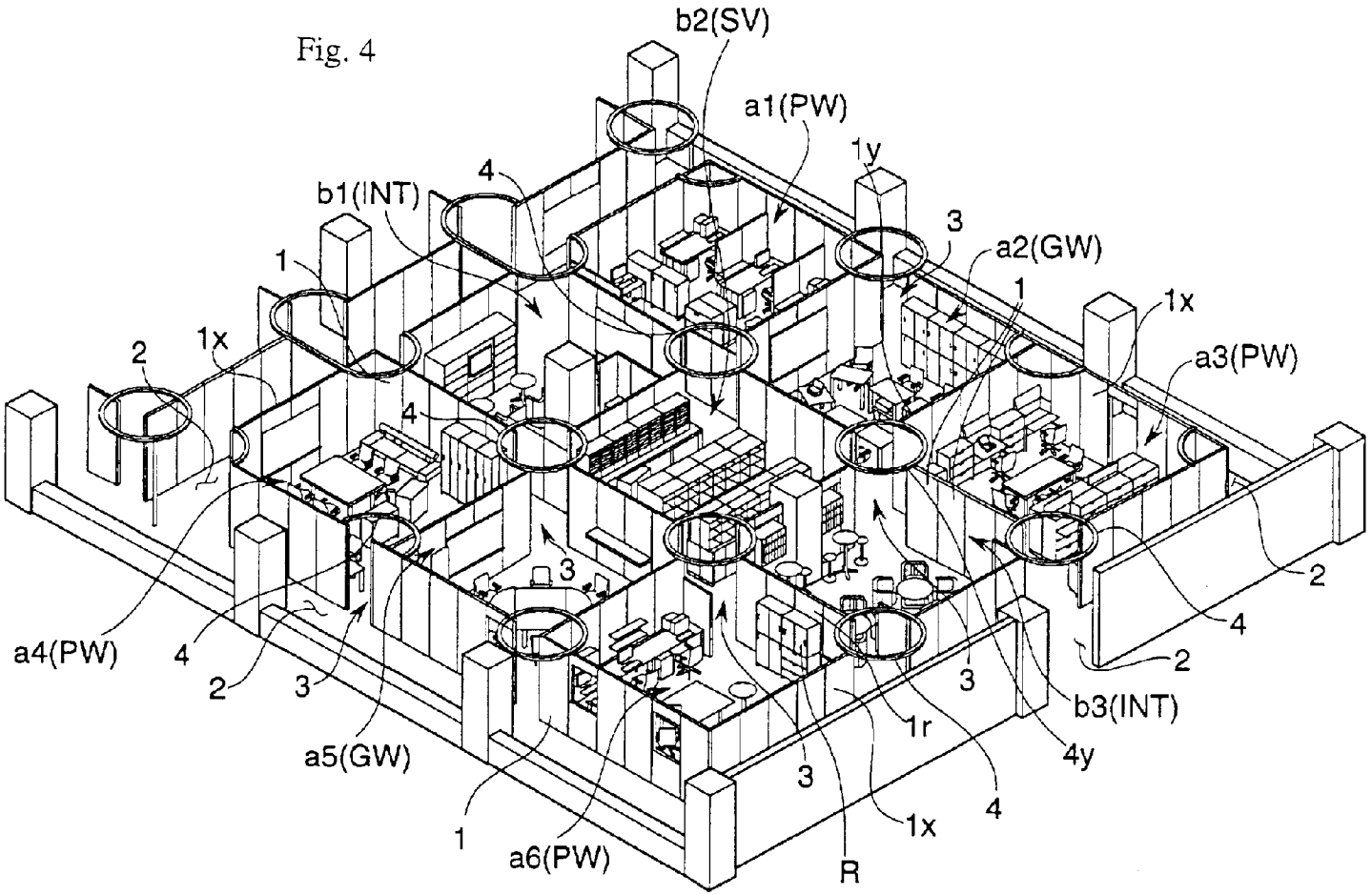
FIG. 4 is a perspective view of a construction developed as a more concrete design from the construction shown in FIG. 3.
Figure 5:
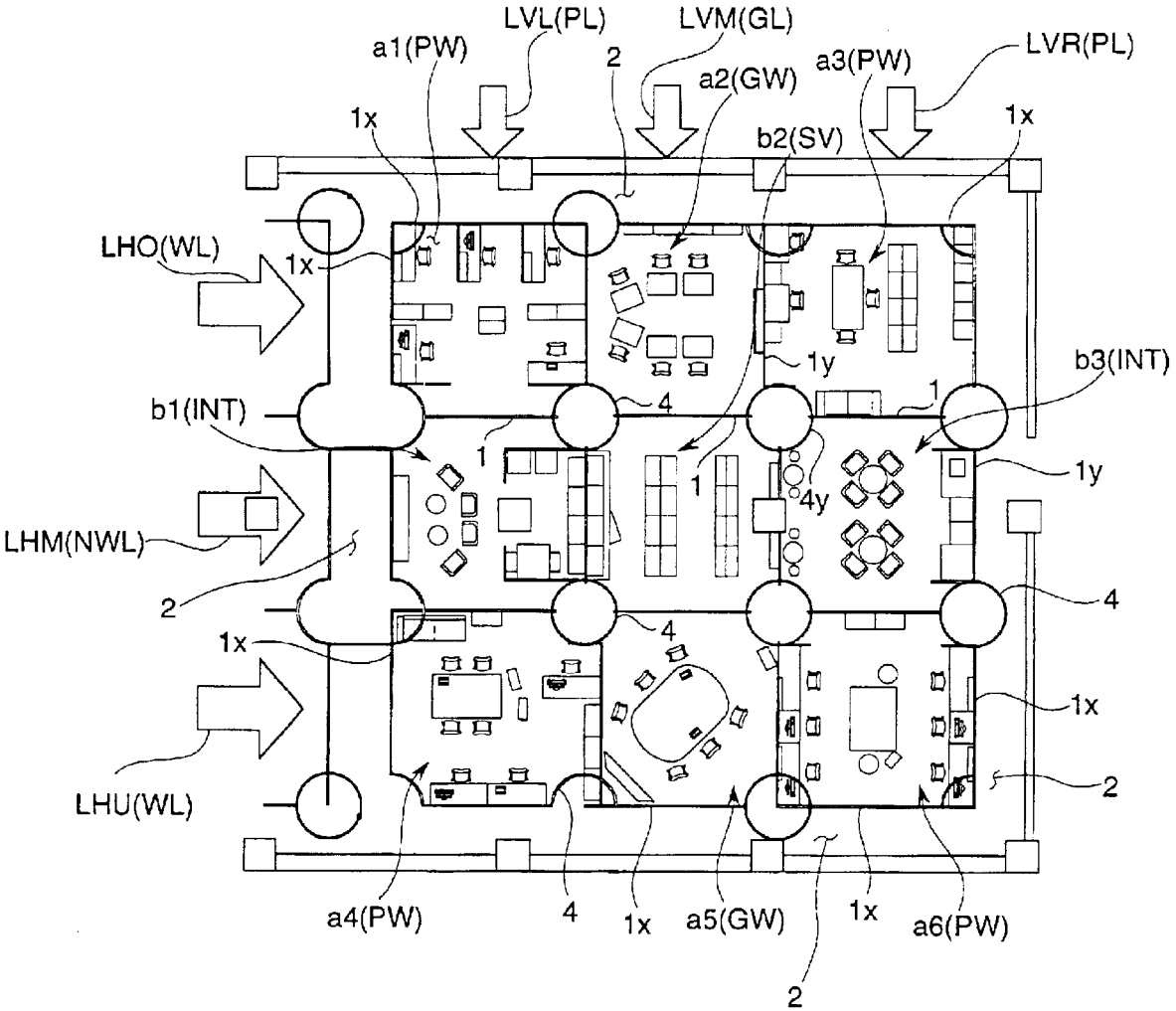
FIG. 5 is a plan view corresponding to FIG. 4.

FIGS. 4 and 5 show a more specific design developed from FIG. 3. Areas a1 to a6 and b1 to b3 are separated from each other by joining partition panels 1 and 1*x* (movable partition walls) with each other, the partition panels being erected planar members. There is no dedicated passageway on the inner sides of partition panels 1*x* delineating the outer extremity of these areas a1 to a6 and b1 to b3, but dedicated passageways 2 are provided on the outer sides of all the partition panels 1*x*.

The shared areas b1 to b3 are utilized as passageways because the shared areas b1 to b3 are centered as a traffic line for traffic between the work areas a1 to a3 and the work areas a4 to a6 or between the work areas and the outside to form a residence space of an excursion type which offers an increased number of chances of encounter and finding or of an arrangement which permits residence of workers, thereby inducing smooth communication between workers.

There is no dedicated passageway on the inner sides of the partition panels 1*x* delineating the outer extremity of the areas because the function of the shared areas b1 to b3 as passageways is to be made effective and because the whole area is to be used as a continuous area which is useful with no waste, highly efficient and systematic. Further, all the peripheral areas are used as dedicated passageways 2 because the space inside the dedicated passageways 2 is definitely delimited as a region for one team or the like, so that differentiation from and communication with other teams can be made effectively.

While areas a1 to a6 and b1 to b3 are delimited from each other and from the passageways 2 with the partition panels 1 arranged to form a letter of "T" or "+", the partition panels 1 are not closed at a corner of each area. That is, this open corner defines gateway 3 which allows direct traffic between one area and another area located adjacent or diagonal thereto. This embodiment allows direct traffic with three areas at the maximum. Such a gateway 3 is applicable to a maximum of four of the corners of an area demarcated rectangular. It is needless to say that there is no need to provide a gateway at a corner at which the provision of a gateway is unnecessary.

Each area is provided with gateway 3 at a corner for allowing direct traffic with other areas therethrough as described above because selectable areas are effectively arranged within a proper walking distance thereby making the traffic between areas smooth and rapid. This arrangement facilitates meeting and parting of workers thereby realizing a layout of the "the right job in the right place" type for supporting selective moves depending on jobs and ensuring a chain of actions and the continuity of moves through a seamless environment between areas. That is, a chain of actions and the continuity of moves in a team work are ensured for workers; for example, it is possible that a worker performs his or her own operation intensively in the personal work area PW, then moves to the group work area GW for a meeting, presentation or the like, optionally enters the interaction area INT if necessary, and returns to the personal work area PW for intensive operation. Also, accidental meeting of the worker with another worker in a shared area during his or her move can facilitate communication therebetween. The effect of supporting workers in this way is enhanced as the number of other areas connected to one area through gateway 3 increases.

In this embodiment, which is an arrangement where different areas are arranged lengthwise and crosswise in a matrix fashion with the partition panels 1 separating one area from another, rows and columns of areas form functional lines on each of which a set of functions are gathered.

Referring to FIG. 5, right-hand lengthwise line LVR and left-hand lengthwise line LVL, which consist of areas arranged lengthwise and crosswise into a matrix pattern, form dedicated lines PL on each of which dedicated areas are grouped, while middle lengthwise line LVM forms a shared line GL on which shared areas are grouped. At the same time, upper crosswise line LHO and lower crosswise line LHU form work lines WL, while middle crosswise line LHM forms non-work line NWL (including the right-hand and left-hand areas functioning as interaction areas and the middle area functioning as a service area). That is, these lines provide the office space with personal work areas (PW) a1, a3, a4 and a6, group work areas (GW) a2 and a5, interaction areas (INT) b1 and b3, and service area (SV) b2. Though the interaction areas (INT) b1 and b3 in this embodiment are shared areas rather than dedicated areas, the present invention does not exclude an area layout including such an exceptional area as long as other areas are arranged in accordance with the aforementioned lengthwise or crosswise functional lines.

While such a systematic functional layout for an office space functions effectively even when it is a minimum unit consisting of four areas gathered, the function of the layout becomes striking when six or more areas are gathered.

Such a matrix layout is employed because the function of each area can be grasped easily and because efficient arrangement of elements can be made on a function-by-function basis when the infrastructure including equipment for electricity, gas, water system and the like is to be constructed. Further, such an arrangement permits the provision of a multiplicity of selectable areas within a proper walking region thereby realizing a layout of the "the right job in the right place" type for supporting selective move depending on jobs.

Here, an example of the construction of each area is illustrated. Each dedicated work area PW (area a1, a3, a4 or a6 in FIGS. 4 and 5, or area d1 in FIG. 6) is constructed to have a total area of about 6 to 4 $m^2$ per seat, to accommodate about 5 to 8 persons therein, and to provide a place for intensive knowledge work. Alternatively, the dedicated work area PW ensures a visitor space or the like when a non-repetitive work is to be done in this area only. Of course, this team-dedicated area can be made to function as a group work area. In this area are placed work surfaces such as defined by desks and whiteboards and clearboards of personal sizes. These elements are preferably elements of an independent type having low interdependence. The work surfaces include work surfaces of different heights to accommodate to a plurality of parallel operations, so that the space can be utilized as efficiently as possible and that an environment allowing a plurality of operations to proceed at a time can be provided.

The shared work areas GW (areas a2 and a5 in FIGS. 4 and 5), on the other hand, are each constructed to accommodate 5 to 8 persons at the maximum therein and to provide a place for discussion or meeting. In each of these areas are provided work surfaces such as of tables adapted for group work and whiteboards and clearboards of group sizes. The work surfaces include work surfaces of different heights to the effect same as described above.

The interaction areas (areas b1 and b3 in FIGS. 4 and 5) each provide a place for chatting or relaxation as a break or a coffee bar for example at a location adjacent work areas. These interaction areas b1, b3 and g1 each may be provided with work surfaces by installing tables or the like as the need arises.

The service area (area b2 in FIGS. 4 and 5) is provided with furniture and equipment required for different services as a copy corner, mail corner, library and retrieval equipment.

According to the conventional area distribution, the main importance is attached to personal work areas, while the supplemental importance attached to group work areas. In one preferred form of this embodiment, however, a larger weight is put on group work areas so that the proportion of the total area of group work areas GW and interaction areas INT becomes substantially equal to the proportion of the total area of personal work areas PW.

As shown in FIGS. 4 and 5, this embodiment is further provided with a guide member 4 at a location above each gateway 3 of a residence space enclosed with the partition panels 1 each comprising an erected planar member, the guide member 4 having at least one portion extending horizontally to interconnect panels 1 on opposite sides of the gateway 3.

Figure 7:
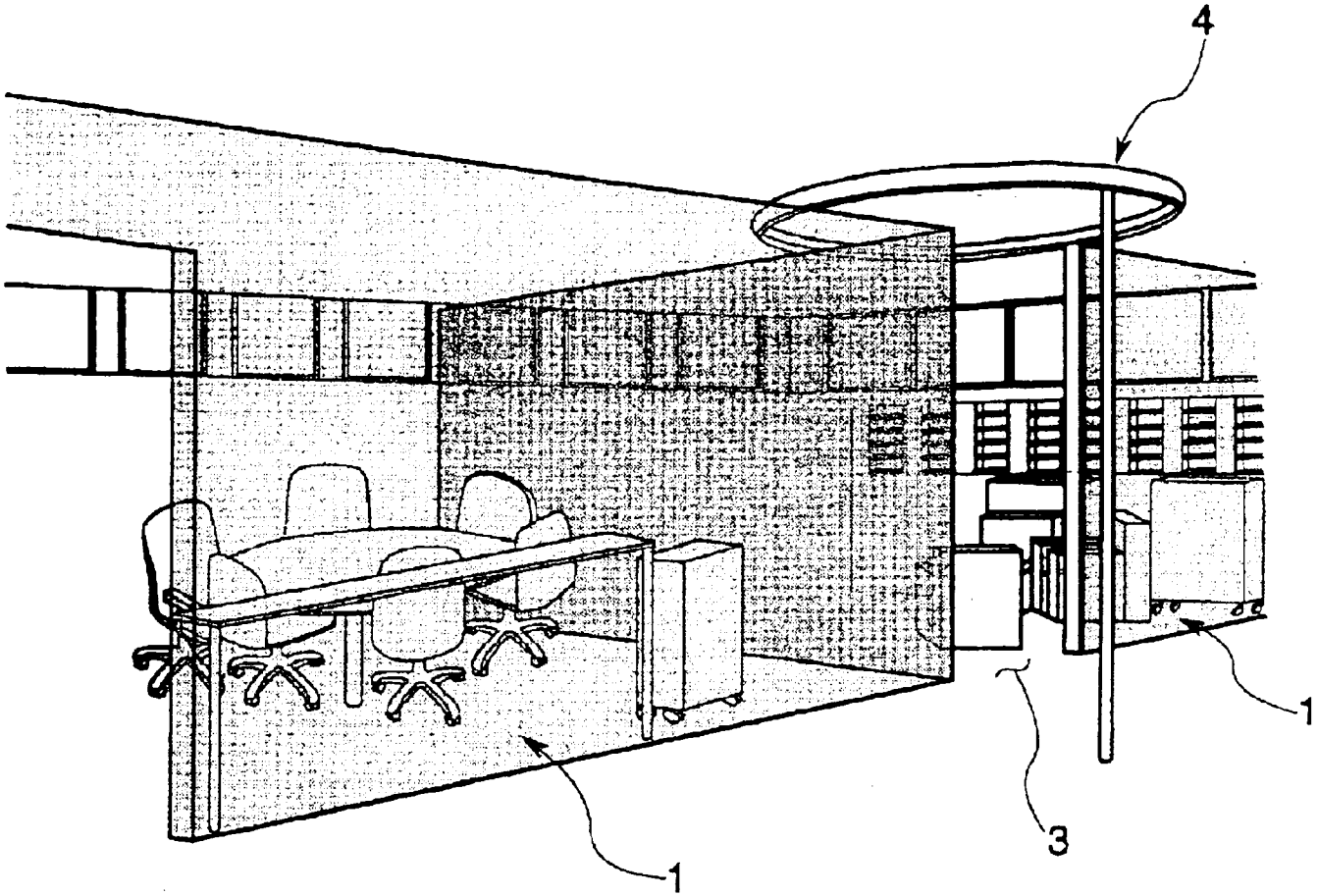
FIG. 7 is a perspective view showing the appearance of a residence space according to the embodiment.
Figure 8:
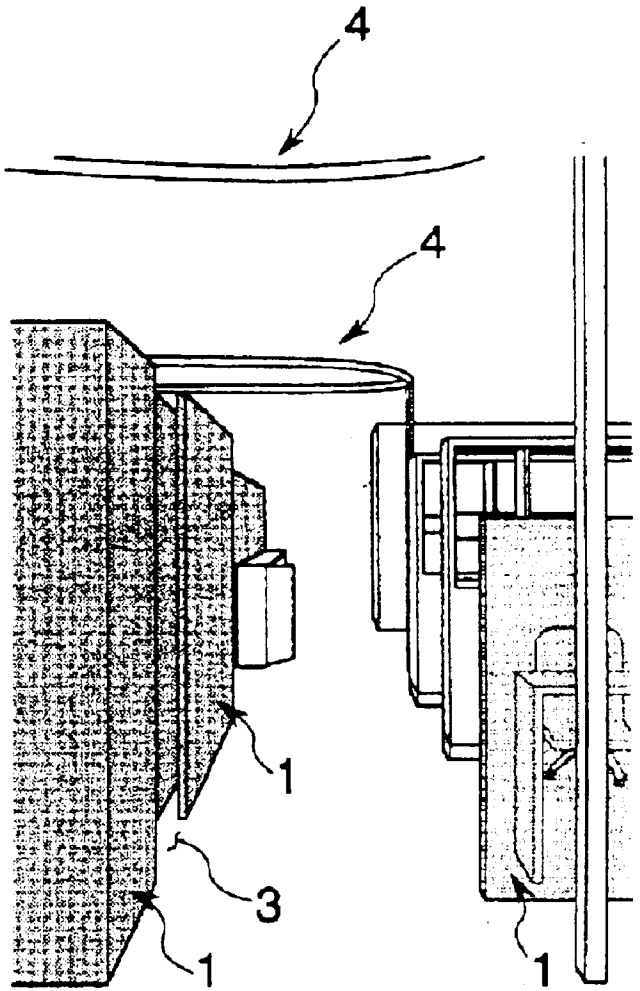
FIG. 8 is a perspective view showing the appearance of a residence space according to the embodiment.

Such a guide member 4 is provided because the guide member 4 serves as a guidepost for persons present in the area or walking in the dedicated passageways to know the location of the gateway 3 of the residence space as shown in FIGS. 7 and 8 thereby ensuring highly efficient and smooth operability for a work team or the like through a chain of actions and continuity of moves. Particularly where the erected planar surfaces continue with each other to form a long wall as shown in FIG. 8, such a long wall gives a monotonous impression and a sensation of pressure to people. The guide member 4, however, brings about a change in design thereby overcoming such an inconvenience. The guide member 4 is configured not only to serve as a guidepost but also to play the role of a connection member for connecting one panel 1 to another. Thus, such connection is capable of effectively prevent each panel 1 from being supported on one side only and aids in properly fixing the guide member 4 to panel 1. Further, the guide member 4 can be utilized as a wiring path between panels 1.

Specific forms of guide member 4 shown in FIGS. 4 and 5 include guide member 4 of a ¼ arc or loop shape used for gateway 3 defined between a pair of panels 1 positioned perpendicularly to each other, guide member 4 of a ½ arc or loop shape used for gateway 3 defined between a pair of panels 1 forming wall surfaces which are continuous and flush with each other, guide member 4 of a ½ arc or loop shape used for gateway 3 defined between three panels 1 assembled to form a "T"-shape, and guide member 4 of a loop shape used for gateway 3 defined between four panels 1 assembled to form a "+"-shape.

Such a guide member 4 of a loop shape or a partial loop shape is used because the shape thereof is novel and hence enhances the functions as a guidepost and as an accent effectively.

In this embodiment, the guide member 4 of a loop or a partial loop shape has a function of fitting a portion thereof to even a panel 1 positioned in a vertical plane that does not extend through the center of an arc formed by the guide member 4. This function is shown as the relation between panel 1*y* and guide member 4*y* in FIGS. 4 and 5. Where the guide member 4 protrudes largely from a panel 1 or in a like case, the guide member 4 may be supported with a pillar.

The guide member 4 imparted with such a function is capable of connecting panels positioned as somewhat deviated from their respective desired positions to appropriate portions of the loop, thereby providing a construction which has a higher degree of freedom as to the arrangement of panels and basically does not need a given module according to which the panels are arranged.

Figure 6:
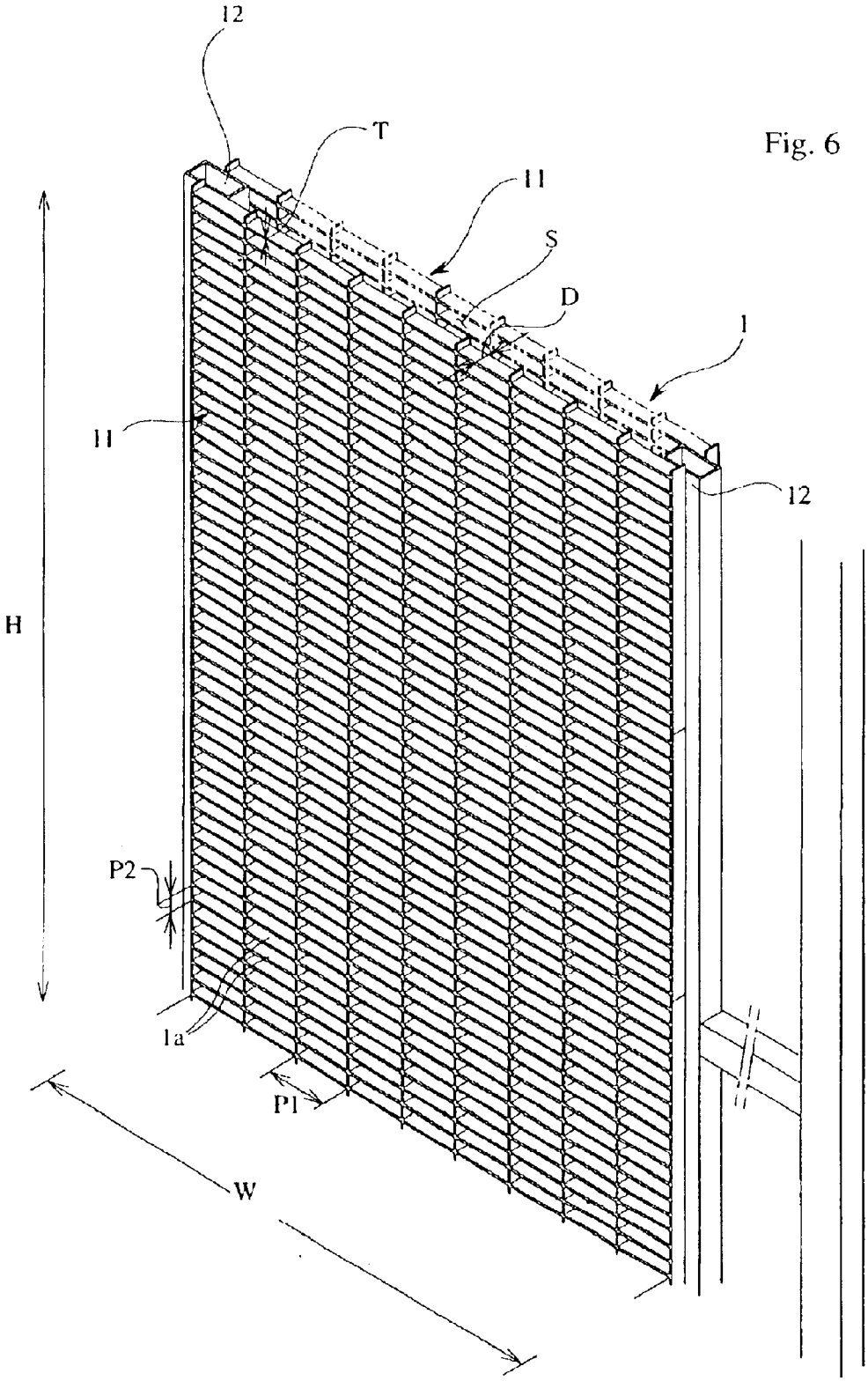
FIG. 6 is a perspective view of a panel used in the embodiment.

The partition panels 1 employed to partition the area in this embodiment are lattice panels as shown in FIG. 6.

Specifically, these panels 1 each comprise a pair of latticework structures 11 that are positioned opposite to each other across a frame member 12 with a predetermined spacing S therebetween so that their respective crossed pieces 1*a* are aligned with each other with an equal pitch and in a same phase, the latticework structures 11 in this position being coupled to each other via the frame member 12. That is, the latticework structures 11 are fitted to the frame member so as to sandwich it therebetween. In this embodiment each of the structures 11 is vertically divided into three portions, which, as a whole, form a single structure when fitted to the frame member 12. The material employed for forming the latticework structures 11 is a carbon fiber reinforced plastic for example.

The panel 1, which is constructed in compliance with a building module for a building having a pillar pitch of 3600 mm for example, has an overall dimensions including width W=900 mm and height H=2100 mm (a portion extending in height is omitted in FIG. 6). The latticework of the panel 1 is symmetric with respect to both a vertical line and a transverse line. The squares defined by the crossed pieces of the latticework of the panel are arranged with a widthwise pitch p1 of about 100 mm and with a vertical pitch p2 of about 25 mm for example. Each crossed piece is in the form of a flat plate having a width T of about 4 mm and a depth D of about 20 mm. Of course, these dimensions may be established appropriately to meet the purpose or use.

The panel 1 is thus constructed for the purposes of: lightening the panel 1 for the ease of assembly and disassembly of the panel 1 without impairing the basic function of the panel 1 as a delimiting wall; improving the operating efficiency associated with assembly and disassembly of the panel 1 by allowing the operator to grip a portion of the latticework of the panel 1 in assembling or disassembling the panel 1; and allowing the panel 1 to be assembled properly without error. The panel 1 is vertically divided into three portions for convenience of handling and for the intermediate portion to be removed to allow the panel 1 to be used in a different way.

The use of panel 1 mainly constructed of such latticework structures 11 makes spaces separated by the panel 1 into such a mutual relation that the visibility of an object in one of the spaces through the panel 1 varies with varying view angle with respect to the erected surface of the panel 1. That is, since the panel 1 has a nature that at a certain view angle, the squares defined in one of the latticework structures 11 are closed with the crossed pieces of the other latticework structure 11 or with the crossed pieces of the same latticework structure 11 like a blind, the visibility assumes the maximum when the panel 1 is viewed in a direction normal to the erected surface thereof, while when the panel 1 is viewed in a direction in the plane of the erected surface thereof, the visibility assumes the minimum. Thus, the visibility varies between the maximum and the minimum with varying view angle (angle of inclination with respect to a line normal to the erected surface of the panel 1). Further, since the panel 1 is thus constructed, opposite residence spaces separated from each other with the panel 1 are continuous with each other through the squares defined in the latticework of the panel 1 and the internal space and, hence, sound and air are permitted to pass through such a space connecting portion.

Thus, a condition is created which allows a person in a residence space adjacent a certain residence space or a person walking in the passageway beside the certain residence space to see the silhouetted internal condition of the space as shown in FIG. 7 or 8, to know fragmentary contents of a talk, and to vaguely understand a context including the location of a group member and the kind of work being done with lapse of time. The silhouetting function of the panel 1 is exercised because the pitches p1 and p2 of the latticework of the panel 1 are relatively small as described above. Of course, it is possible to know the location of a person and the contents of a work being done more clearly if attention is given to the periphery of the silhouette.

The subject embodiment, in particular, is configured such that each area is enclosed with panels 1 on the four sides thereof to define a closed residence space, the internal condition of which can be necessarily grasped from the four sides by a person in an adjacent residence space, an adjacent passageway or the like, so that the image of the inside condition of the residence space is diffused toward the periphery at the highest efficiency. Further, the subject embodiment allows a person in a residence space to vaguely see the internal condition of a residence space situated adjacent to and beyond the residence space next to the residence space where the person is present though the silhouette is thinner, so that workers are able to catch the situation of the whole office extensively and hence to share the context, while their privacy is guaranteed to such an extent as to be needed for their personal works.

Figure 9:
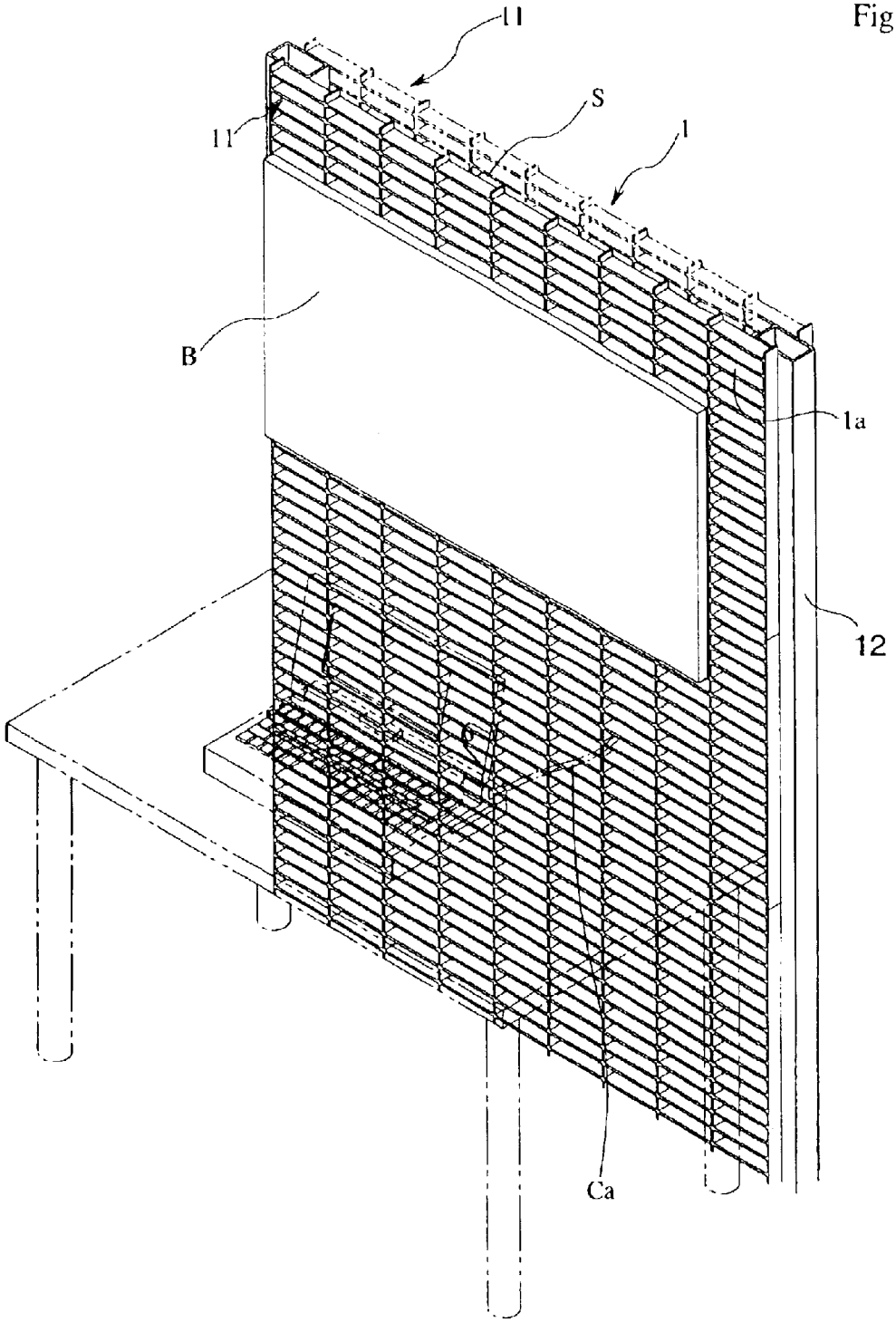
FIG. 9 is a perspective view illustrating a function of the panel used in the embodiment.

Each panel 1 has a space S inside its panel body and the space S can be utilized to accommodate wiring Ca therein as shown in FIG. 9. Since the structures 11 forming each panel 1 used in this embodiment are of latticework, the wiring can be led out in the direction normal to the panel body from any position in the homogeneous portion of the panel body through a square defined in the latticework. The "panel body", as used herein, is referred to as a part comprising at least a combination of the structures 11 and the frame member 12. Accordingly, panel 1 can exercise a function as a service wall that can accommodate to the needs of workers easily and properly even when the position from which the wiring is led out varies differently to meet different uses. Since panel 1 used in the subject embodiment, in particular, comprises the pair of opposite structures 11 facing each other, the wiring can be led out from either or both of the obverse and reverse sides of panel 1. Thus, panel 1 of this configuration is effective particularly where residence spaces are formed on opposite sides of the panel 1.

Since the pitches of crossed pieces of the latticework of the panel 1 are relatively small as described above, the crossed pieces of the latticework are expect to provide a blinding effect which conceals the inside wiring by silhouetting, thereby preventing the wiring from being seen unconcealedly.

For the wiring function of panel 1 to be fulfilled effectively, it is effective that an appropriate wiring path hole or a like hole is defined in a portion of the frame member or the like so that the respective wiring accommodating spaces of adjacent panels 1,1 becomes continuous with each other.

Further, since panel 1 thus constructed according to the subject embodiment defines a space behind the crossed pieces of each latticework structure, it is possible that interior equipment B is engaged with panel 1 at a position in a homogeneous portion of structure 11 through the crossed pieces by means of an appropriate fixture or the like. Panel 1 of such a construction enhances the freedom of selection of engagement positions by far and hence is capable of exercising a function as a service wall which satisfies heterogeneous and on-demand requests of workers properly. Since the structures 11 making a pair face each other, the interior equipment B can engage a crossed piece 1*a* on either or both of the obverse and reverse sides of panel 1 and mutual interference between fixtures and the like hooked on the obverse and reverse sides can effectively be avoided. It is possible to employ appropriate forms of engagement including an engaging structure utilizing a hook-shaped fixture, and a fitting structure utilizing a clip-shaped or clamp-shaped fixture to fit the interior equipment to the crosspieces of latticework. Examples of interior equipment B include interior equipment having a work surface such as a whiteboard, interior equipment having a display function such as a tagboard, bulletin board, display panel and sign, interior equipment having a storage function such as a cabinet, shelf, sorter and storage shelf, a receptacle box, and a switch. Where an auxiliary panel is disposed relative to panel 1 to form a T-shaped arrangement, the panel 1 itself serves as interior equipment B.

Since panel 1 allows interior equipment B to be engaged with or secured to the panel 1 at an appropriate position, the number of chances of presenting ideas or thinking processes at an informal stage as well as of displaying or presenting formally can be increased, which is helpful in stimulating and activating creative works. Particularly where the interior equipment calls for electric power, the effect provided by the latticework structure is enhanced synergistically since wiring Ca can be led out through a square defined in the latticework.

Figure 10:
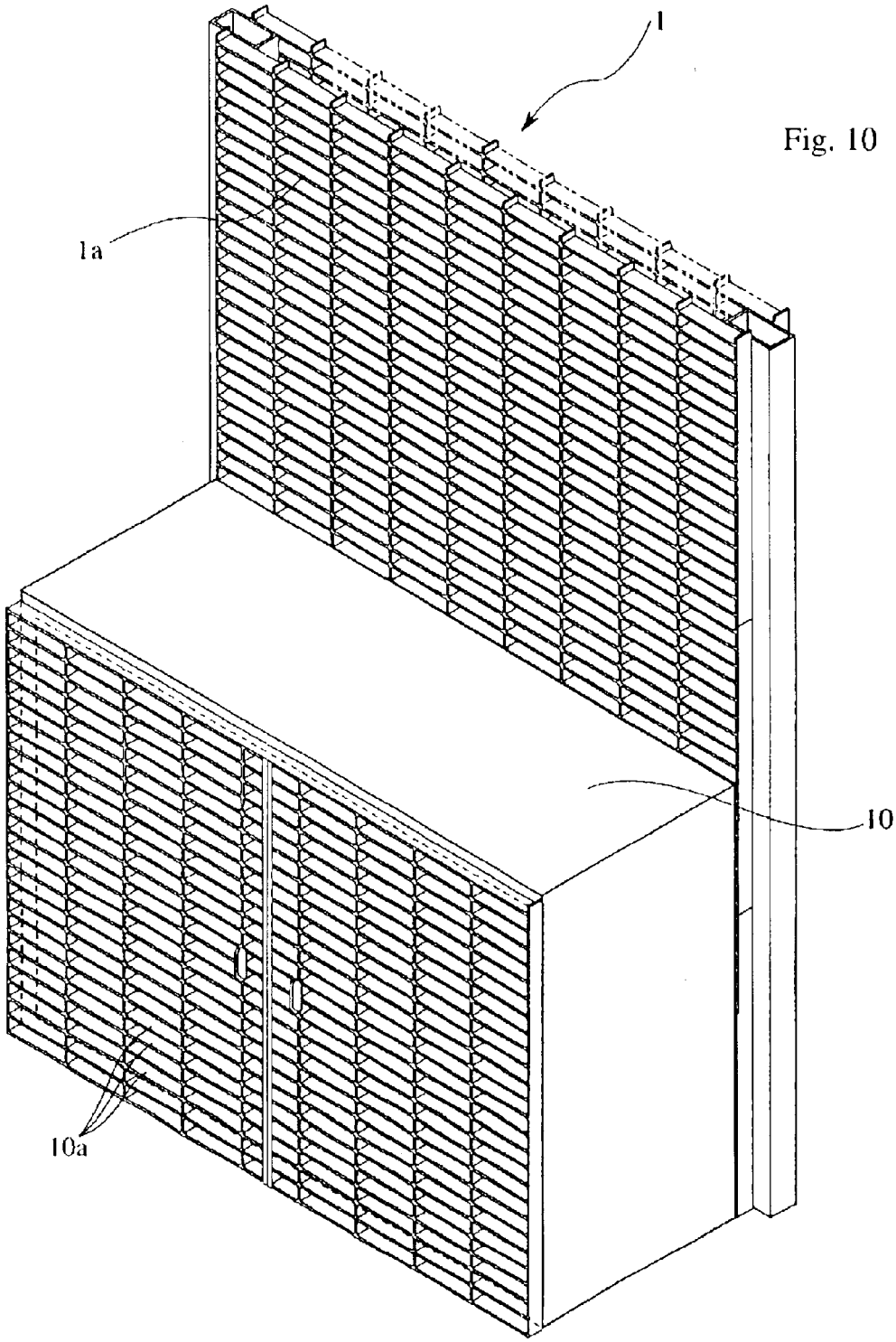
FIG. 10 is a perspective view showing interior equipment secured to the panel used in the embodiment by engagement.

Further, it is effective that furniture to be disposed in butting relation to the facing part of panel 1, e.g., storage furniture 10 shown in FIG. 10, such as a panel shelf or a cabinet, is provided with a latticework 10*a* assuming the same phase as and having an equal pitch to latticework 1*a* for engagement to be concealed by the furniture 10 when it is disposed in butting relation to the panel 1. This is because the latticework 10*a* of the furniture 10 exercises the engagement function instead of the latticework 1*a* even when the latticework 1*a* of the panel 1 is covered. Of course, such a compensating function may be any other function than the engagement function as long as the functional sections of the furniture are equivalent to those of the panel 1. Such an arrangement is effective particularly where the functional sections are dispersed over the entire face of panel 1.

Meanwhile, the equipment according to the subject embodiment allows use of a variety of furniture articles regardless of building modules. Representatives of such building modules are 3600 mm and 3200 mm on a basis of pillar grid. Partition panel 1 usually employs a standardized width of 900 mm, which is a divisor of the former if the panel 1 is compliant therewith, or a standardized width of 800 mm, which is a divisor of the latter if the panel 1 is compliant therewith. There are various standardized widths, such as 400 mm, 800 mm, 900 mm, 1000 mm, 1200 mm, 1400 mm, 1600 mm and 1800 mm, which are compliant with modules for the top surface of a desk or table forming a work surface, a cabinet, a human body and paper products. Since contemporary offices accommodate a number of intermingled furniture articles compliant with different modules, it is undeniable that when, for example, a furniture article of 800 mm width or 1600 mm width is disposed in butting relation to a panel face formed of joined panels 1 of 900 mm width, slight irregularity and unnatural gaps are formed therebetween.

In contrast, the subject embodiment permits use of a combination of panel 1 compliant with a building module of a multiple of 900 mm and furniture articles compliant with different modules for human body and paper products.

Even when a gap is defined between an end of panel 1 and an end of a furniture article or between a joint between panels 1 and an end of a furniture article as in the case where an existing light-shielding panel is used, the visibility of the gap is low and, hence, the gap is not so tangible, since the presence of panel 1, which is semi-transparent, is not felt so much. That is, panel 1 used in the subject embodiment allows indefinite alignment with a building module thereby making it possible to enhance the sharing and interchangeability of furniture articles. This is represented by the relation between interior equipment B and panel 1 shown in FIG. 9 or the relation between locker R and panel 1*r* shown in FIG. 4. When a gap is formed, the gap can be positively utilized as a space for installation of a switch, a fire extinguisher or the like.

The width of each square defined in the latticework of panel 1 used in the subject embodiment is set to 100 mm as already described because this size accommodates to modules sized to multiples of 100 mm for many conventional partition panels and furniture articles. For this reason, even when a difference of a multiple of 100 mm in widthwise dimension is formed between joined panels and joined furniture articles, the other end of the joined furniture articles can always be positioned as conforming to a crossed piece of the latticework of panel 1, with the result that incongruity resulting from a module difference is cancelled effectively.

While one embodiment of the present invention has been described, specific features of the present invention are not limited to those of the foregoing embodiment.

For example, it is possible to employ an area layout such that work areas are arranged so as to surround a shared area and that traffic between each work area and the shared area is possible.

Guide member 4 of a loop or partial loop shape may have a function of being fitted to a panel 1 positioned in any vertical plane radially extending through the center of an arc formed by the guide member 4 within the effective fitting range of the guide member 4 by any appropriate means. Such a configuration enables free selection of any desired fitting direction of panel 1.

As other means for avoiding formation of a gap between a panel and furniture due to a difference between modules with which the panel and the furniture, respectively, are compliant, such means is effective that one of the panel and the furniture is provided with a size adjustment function capable of compensating for the gap.

It is also effective that the visibility through the panel is rendered variable. In this respect, an arrangement is effective which is capable of driving crossed pieces of the latticework like a louver or which is capable of indirectly adjusting the visibility through the panel by varying the luminous intensity inside or outside a residence space.

If the furniture is semi-transparent, disclosure of local documents is facilitated so that the context of the whole office can be known more effectively.

Further, it is effective that the guide member is provided with a lighting instrument on the upper or lower side thereof. In this case the ceiling or the floor is illuminated as reflecting the guide member and, hence, the guide member becomes more effective as a guidepost.

It is also effective that the office forming equipment is arranged such that the visibility through the erected planar member assumes a maximum when the erected planar member is viewed in a direction normal to the erected surface of the erected planar member, while when the erected planar member is viewed in a direction in the plane of the erected surface, the visibility assumes a minimum.

Other features may also be modified variously without departing from the spirit of the present invention.

Industrial Applicability

The present invention, which is of the arrangement applicable to offices or the like as described above, is capable of effectively realizing the provisions of diversified space functions on a use-by-use basis, semi-transparently screened spaces and a seamless space layout, thereby markedly raising the efficiency of a knowledge-intensive organization.

What is claimed is:

1. Office forming equipment comprising a plurality of erected planar members partitioning a residence space of an office, wherein each of the erected planar members comprise a pair of latticework structures arranged to face each other with a predetermined spacing therebetween, each of the latticework structures being constructed with a plurality of crossed pieces, wherein each crossed piece is in the form of a flat plate, wherein at least one of the erected planar members separates a pair of spaces and is configured such that visibility through the erected planar member from one space to the other varies with varying view angle with respect to an erected surface of the erected planar member.

2. The office forming equipment according to claim 1, wherein the residence space is enclosed with erected planar members and has an inside visible from four sides.

3. The office forming equipment according to claim 1, wherein the visibility through the erected planar member assumes a maximum when the erected planar member is viewed in a direction normal to the erected surface of the erected planar member, while when the erected planar member is viewed in a direction in a plane of the erected surface, the visibility assumes a minimum.

4. The office forming equipment according to claim 3, wherein the pair of spaces separated from each other with the erected planar member are continuous with each other through a space connecting portion of the erected planar member, the space connecting portion permitting sound and air to pass therethrough.

5. The office forming equipment according to claim 3, wherein the residence space is enclosed with erected planar members and has an inside visible from four sides.

6. The office forming equipment according to claim 1, wherein the pair of spaces separated from each other with the erected planar member are continuous with each other through a space connecting portion of the erected planar member, the space connecting portion permitting sound and air to pass therethrough.

7. The office forming equipment according to claim 6, wherein the residence space is enclosed with erected planar members and has an inside visible from four sides.

* * * * *